US005100198A

United States Patent [19]

Baltzell

[11] Patent Number: 5,100,198

[45] Date of Patent: Mar. 31, 1992

[54] SEAT COOLER APPARATUS

[76] Inventor: Ricky L. Baltzell, 1013 Maple Dr., Kansas City, Mo. 64118

[21] Appl. No.: 594,418

[22] Filed: Oct. 9, 1990

[51] Int. Cl.[5] ..... A47C 7/72

[52] U.S. Cl. ..... 297/192; 297/217; 312/235.2; 43/54.1

[58] Field of Search ..... 297/192, 188, 193, 217; 312/235.2, 235.3, 235.4, 235.5, 235.6, 235.8, 244, 296, 214, 250; 43/25, 54.1; D6/336

[56] References Cited

U.S. PATENT DOCUMENTS

| | | | |
|---|---|---|---|
| D. 293,632 | 1/1988 | Capocasa | D6/336 |
| 302,680 | 7/1884 | Adams | 297/217 |
| 2,264,744 | 12/1941 | Dunnam | 297/192 |
| 2,493,084 | 1/1950 | Pharo | 312/235.2 X |
| 4,128,170 | 12/1978 | Elliot | 43/54.1 X |
| 4,228,894 | 10/1980 | Lyles | 312/235.2 |
| 4,317,607 | 3/1982 | Gromolka | 312/296 X |
| 4,460,188 | 7/1984 | Maloof | 297/193 X |
| 4,722,567 | 2/1988 | Hashihara | 297/217 |
| 4,745,704 | 5/1988 | Schaefer | 297/192 X |
| 4,773,709 | 9/1988 | Slinkard | 297/183 X |
| 4,789,200 | 12/1988 | Munguia | 297/184 |
| 4,946,180 | 8/1990 | Baer | 297/155 X |

FOREIGN PATENT DOCUMENTS

| | | | |
|---|---|---|---|
| 2569948 | 3/1986 | France | 297/188 |

*Primary Examiner*—Kenneth Dorner
*Assistant Examiner*—James M. Gardner
*Attorney, Agent, or Firm*—Leon Gilden

[57] ABSTRACT

A seat cooler apparatus is set forth including a cushion seat member removably mounted relative to an underlying cabinet, wherein the cabinet includes a cooler chest defined by an extensible and retractable drawer container within the cabinet. A modification of the invention includes an extensible cushion member overlying the drawer, and further including retractable wheels mounted to side walls of each cabinet for portability of the organization.

1 Claim, 4 Drawing Sheets

SEAT COOLER APPARATUS

BACKGROUND OF THE INVENTION

1. Field of the Invention

The field of invention relates to combination seat arrangements, and more particularly pertains to a new and improved seat cooler apparatus wherein the same permits storage of food and the like within the cabinet during a fishing procedure.

2. Description of the Prior Art

Various seat combinations have been utilized in the prior art for use in a fishing environment and the like, as in the instant invention. An example of such may be found in U.S. Pat. No. Des. 293,632 to Capocasa.

U.S. Pat. No. 4,773,709 to Slinkard sets forth a further example of a seat and insulated cooler organization wherein the seat is pivotally mounted to an underlying base, wherein the seat includes a cavity for use as a cooler arrangement.

U.S. Pat. No. 4,128,170 to Elliott sets forth a combination tackle box and cooler with a seat means for use in a fishing organization.

As such, it may be appreciated that there continues to be a need for a new and improved seat cooler apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of seat cooler arrangements now present in the prior art, the present invention provides a seat cooler apparatus wherein the same sets forth a convenient cooler arrangement mounted within a cabinet with an overlying seat removably mounted relative to the cabinet for use in combination with a fishing pole support and umbrella organization. As such, the general purpose of the present invention, which will be described subsequently in greater detail, is to provide a new and improved seat cooler apparatus which has all the advantages of the prior art seat cooler arrangements and none of the disadvantages.

To attain this, the present invention includes a seat cooler apparatus with a cushion seat member removably mounted relative to an underlying cabinet, wherein the cabinet includes a cooler chest defined by an extensible and retractable drawer container within the cabinet. A modification of the invention includes an extensible cushion member overlying the drawer, and further including retractable wheels mounted to side walls of each cabinet for portability of the organization.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially and scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved seat cooler apparatus which has all the advantages of the prior art seat cooler arrangements and none of the disadvantages.

It is another object of the present invention to provide a new and improved seat cooler apparatus which may be easily and efficiently manufactured and marketed.

It is a further object of the present invention to provide a new and improved seat cooler apparatus which is of a durable and reliable construction.

An even further object of the present invention is to provide a new and improved seat cooler apparatus which is susceptible of a low cost of manufacture with regard to both materials and labor, and which accordingly is then susceptible of low prices of sale to the consuming public, thereby making such seat cooler apparatus economically available to the buying public.

Still yet another object of the present invention is to provide a new and improved seat cooler apparatus which provides in the apparatuses and methods of the prior art some of the advantages thereof, while simultaneously overcoming some of the disadvantages normally associated therewith.

Still another object of the present invention is to provide a new and improved seat cooler apparatus wherein the same sets forth an organization for ease of portability and compactness in construction.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
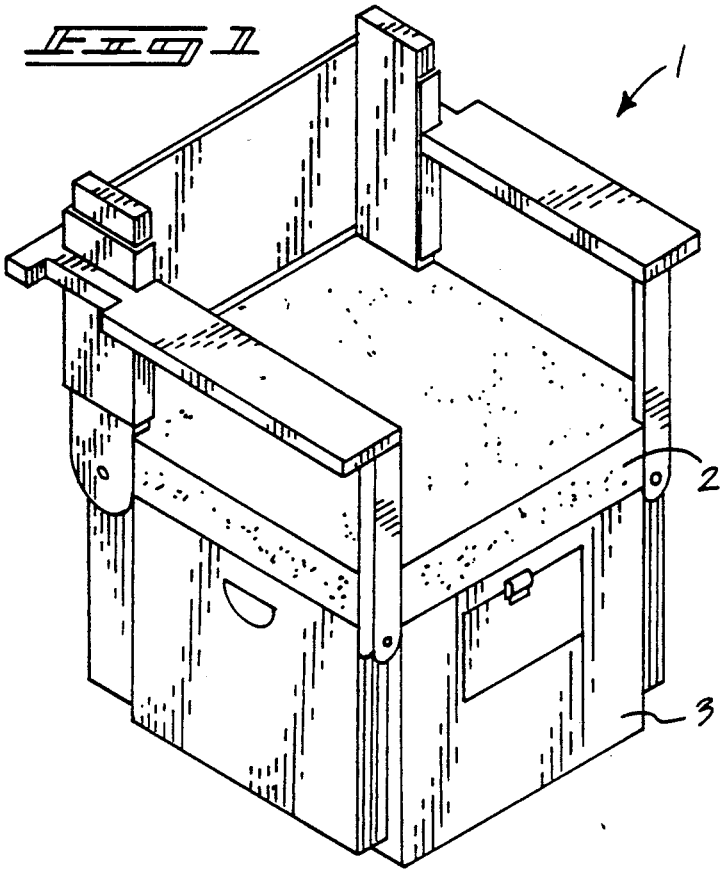
FIG. 1 is an isometric illustration of a prior art seat cooler organization.
Figure 2:
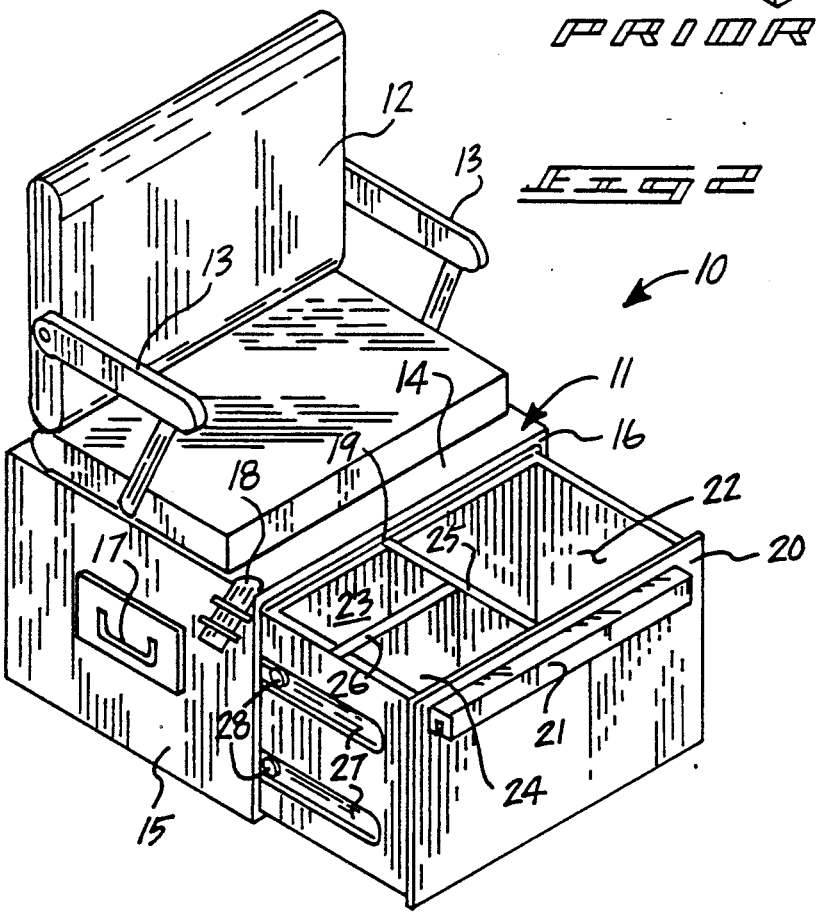
PRIOR ART FIG 2
FIG. 2 is an isometric illustration of the instant invention.
Figure 3:
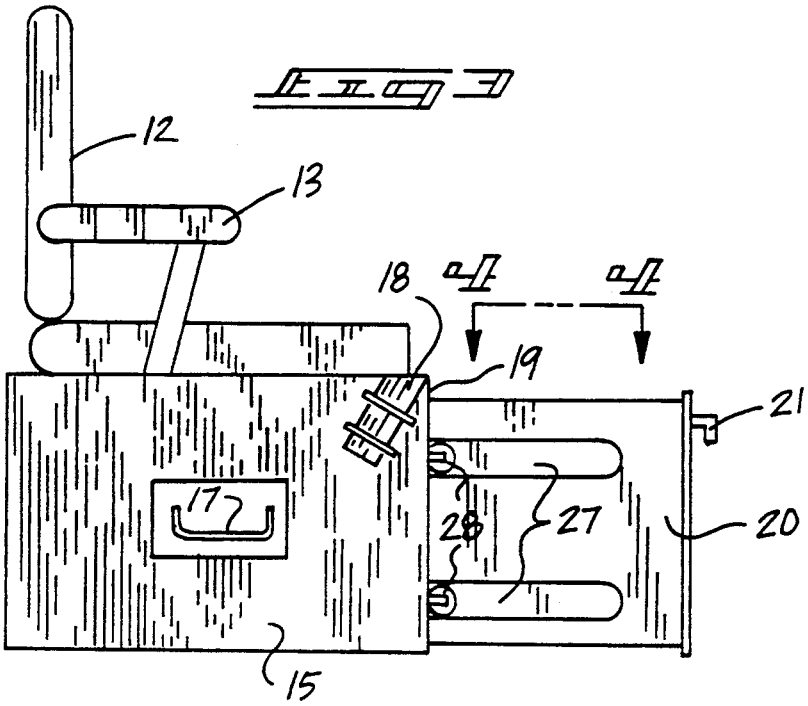
FIG. 3 is an orthographic side view, taken in elevation, of the instant invention.

With reference now to the drawings, and in particular to FIGS. 1 to 9 thereof, a new and improved seat cooler apparatus embodying the principles and concepts of the present invention and generally designated by the reference numerals 10 and 10*a* will be described.

FIG. 1 illustrates a prior art seat cooler organization 1, as exemplified in U.S. Pat. No. Des. 293,632, wherein a cushion member 2 is mounted upon a cabinet 3.

Figure 8:
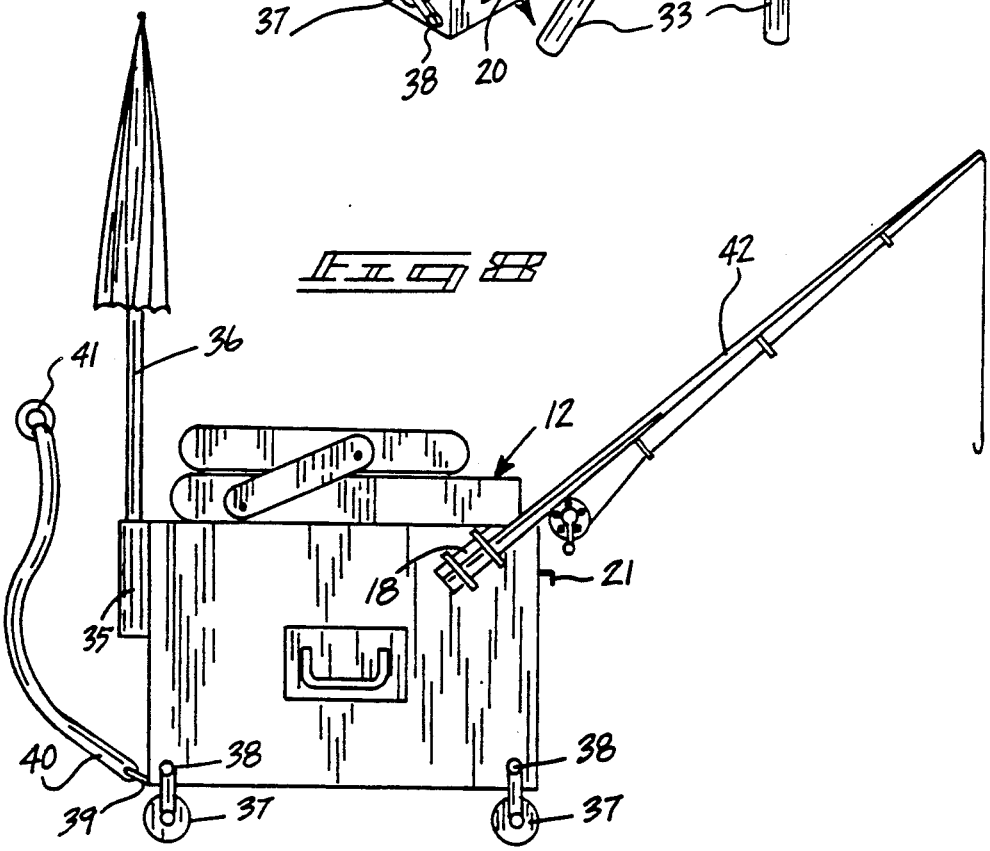
FIG. 8 is an orthographic side view of the modified seat cooler apparatus utilized by the instant invention.

More specifically, the seat cooler apparatus 10 of the instant invention essentially comprises a cooler cabinet 11 formed of a parallelepiped configuration, including an "L" shaped cushion seat plate 12 mounted thereon, including a horizontal portion and a vertical portion, with lateral arm rest members 13 mounted to the horizontal and vertical portions, wherein the arm rest members may be formed to include pivot axles to permit interfolding of the horizontal and vertical portions, in a manner as illustrated in FIG. 8. The cabinet 11 includes a cabinet top wall 14, parallel cabinet side walls 15, and a cabinet forward wall 16. Each side wall 15 includes a side handle 17 mounted thereon for manual transport of the organization. An elongate fishing rod supporting bore 18 is directed through the top wall 14 for mounting of a fishing pole 42, in a manner as illustrated in FIG. 8. The bore 18 is arranged at an acute included angle between the top wall 14 and an axis defined by the bore to direct fishing rod 42 forwardly, in a manner as illustrated in FIG. 8.

Figure 4:
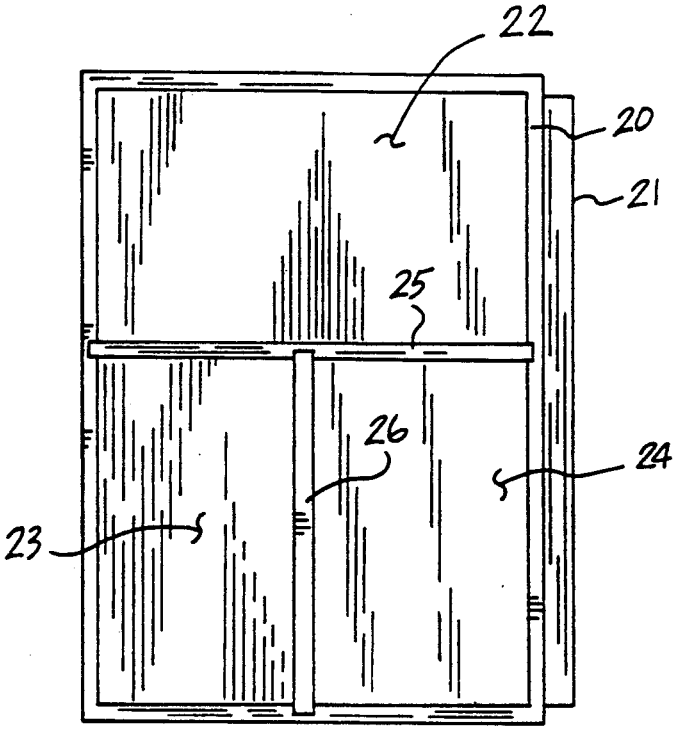
FIG. 4 is an orthographic top view of the cooler drawer utilized by the instant invention.

Reciprocating drawer 20 defined by a predetermined length is received within the cabinet 11 through the forward wall 16 and cooperates with a continuous polymeric seal 19 mounted on the forward wall about the drawer 20 to effect sealing of the drawer within the cabinet 11. The drawer and its predetermined length is substantially equal to a cabinet length defined by a length of the side or top wall 15 or 14 respectively. A drawer handle 21 is mounted to the drawer 20 to permit manual grasping thereof, with the drawer 20 defining a respective first, second, and third cavity 22, 23, and 24. The cavities are defined by a first partition wall 25 bisecting the interior cavity of the drawer 20, with a second partition wall 26 orthogonally bisecting the first partition wall, in a manner as illustrated in FIG. 4. Parallel guide slots 27 are formed within each exterior surface of each side of the drawer 20 and cooperating with guide rods 28 to guide and align the drawer within the cabinet structure 11.

Figure 5:
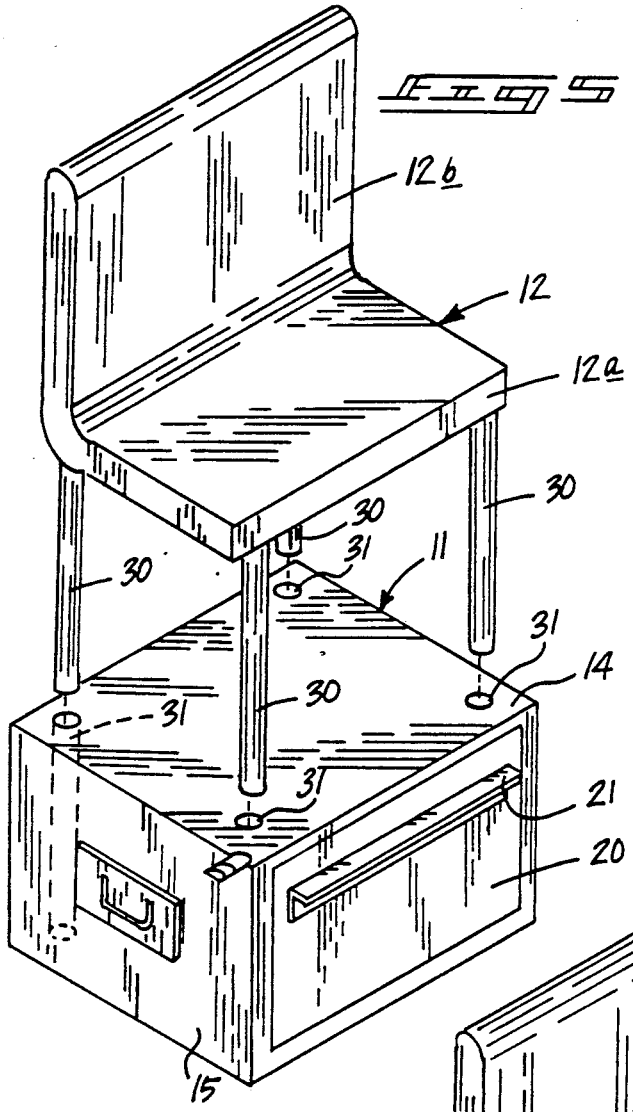
FIG. 5 is an isometric illustration setting forth the relationship of the seat relative to the cabinet structure of the instant invention.

With reference to FIG. 5, the seat 12 includes a horizontal and vertical seat plate 12*a* and 12*b* respectively, with a cylindrical seat leg 30 mounted adjacent each corner of the horizontal seat plate 12*a* extending orthogonally and downwardly therefrom, with each seat leg 30 slidably received within a respective cabinet leg bore 31 that is coextensively directed through the cabinet from the top wall 14 through the floor of the cabinet, with each seat leg 30 defined by a seat leg length substantially equal to a side wall height such that an individual mounted upon the seat 12 directs the force upon the seat legs and not upon the cabinet to prevent deformation of the cabinet in use. The bores 31 are positioned adjacent each side wall of the cabinet between the drawer 20 and each respective side wall to avoid interference with the drawer in its operation.

Figure 6:
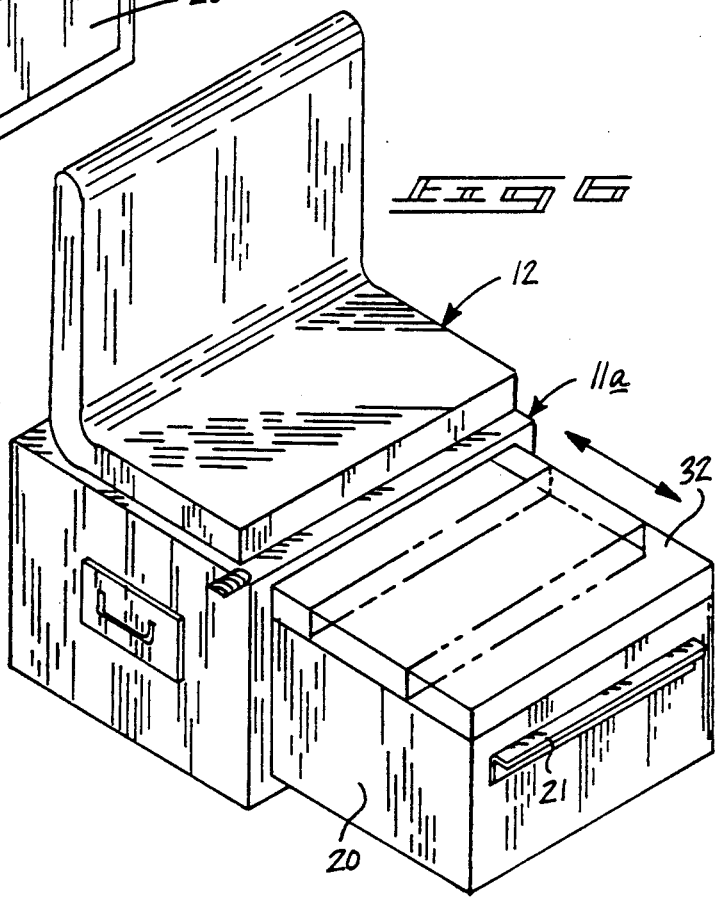
FIG. 6 is an isometric illustration of the seat and cabinet in an assembled configuration.
Figure 7:
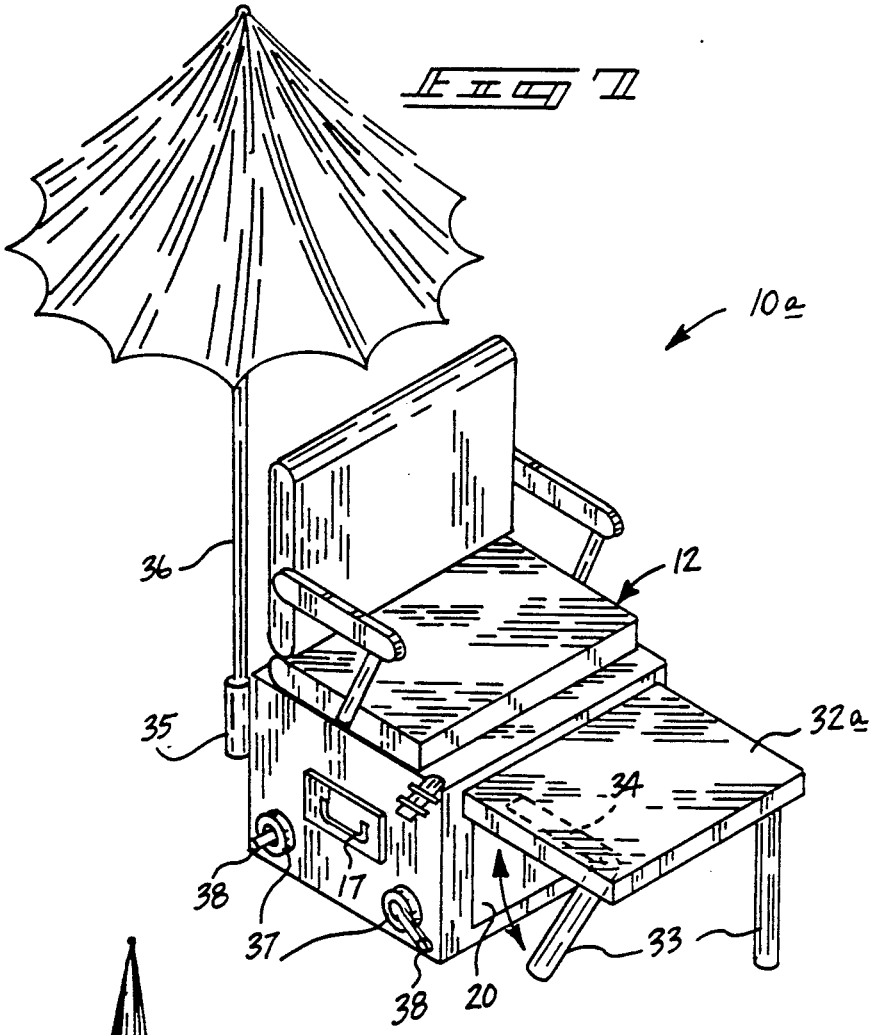
FIG. 7 is an isometric illustration of a modified seat cooler organization as utilized by the instant invention.

FIG. 6 illustrates a modified cabinet 11*a* utilizing an extensible cushion 32 defined by a predetermined length equal to the predetermined length of the drawer 20 to overlie the drawer selectively and provide a foot rest during use. FIG. 7 illustrates a modified extensible cushion 32*a*, including a cylindrical cushion recess mounted through a bottom surface of the modified cushion 32*a* to receive an associated cushion leg 33 therewithin that is pivotally mounted to the cushion to permit the cushion to be utilized independently of the drawer 20. Further, a support cylinder 35 is mounted upon a rear wall of the cabinet for support of the umbrella 36 that is collapsible during use. Further, the modified apparatus 10*a* includes rectractable wheel members 37 that are mounted about wheel support pivot axles 38 that may be extended for ease of transport of the organization. A seat support hook 39 is mounted to the rear wall to receive a forward end of the support rope 40, with the rear end of the support rope 40 mounted to a rear support mount 41 to permit securement thereof during use.

Further, it should be noted that as only one of the side walls 11 have been illustrated, it is to be understood that the opposing side wall is simply of a mirror image construction as is understood by one of ordinary skill in the art.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A seat cooler apparatus comprising, a cabinet, the cabinet including a top wall, spaced parallel side walls, and a forward wall spaced forwardly of and parallel to a rear wall, and the cabinet including a seat means mounted thereon for accommodation of an individual positioned on the seat means, and a single drawer member slidably mounted within the cabinet through the forward wall extensible and retractably positionable relative to the cabinet for accommodating components positioned therewithin, and wherein a continuous polymeric seal is mounted on the forward wall between the forward wall and a forward drawer wall to sealingly secure the drawer within the cabinet, and including an elongate rod supporting bore directed through the top wall and one of said side walls defining an acute included angle between an axis defined by the bore and the top wall, and wherein each side wall includes a handle mounted thereon, and wherein the drawer includes a drawer cavity, and a first partition wall bisecting the drawer cavity, and a second partition wall orthogonally mounted to the first partition wall to define a first, second, and third cavity within the drawer cavity, and wherein the seat means includes a horizontal seat plate and a vertical seat plate, and the horizontal seat plate includes a cylindrical seat leg, and the horizontal seat plate defines a rectangular configuration, with a seat leg orthogonally and integrally mounted to a bottom surface of the horizontal seat plate adjacent each corner of the horizontal seat plate, and the cabinet including a cabinet leg bore coextensively directed through the cabinet from the top wall through a floor of the cabinet, and each cabinet leg bore is defined by a cabinet bore length, and each seat leg is defined by a seat leg length equal to the cabinet bore length, and wherein the cabinet includes a support cylinder integrally mounted to an outer wall of the cabinet, with the support cylinder releasably including an umbrella rod and umbrella mounted therewithin, and wherein each side wall includes a plurality of wheel members, each wheel member pivotally mounted to a respective side wall about a wheel support pivot axle from a first retracted position spaced above the floor of the cabinet to an extended position spaced below the floor of the cabinet, and wherein the rear wall of the cabinet includes a support hook mounted thereon, and a rope mounted to the seat support hook and the seat support hook selectively secured to a rope support mount to secure the cabinet in a predetermined orientation.

* * * * *